US005794633A

United States Patent [19]

Song

[11] Patent Number: 5,794,633

[45] Date of Patent: Aug. 18, 1998

[54] WASHING MACHINE WITH SUB-PULSATORS

[75] Inventor: Won-Jin Song, Kwangju, Rep. of Korea

[73] Assignee: Daewoo Electronics Co., Ltd., Rep. of Korea

[21] Appl. No.: 865,936

[22] Filed: May 30, 1997

[30] Foreign Application Priority Data

May 31, 1996 [KR] Rep. of Korea ..... 96-19441

[51] Int. Cl.[6] ..... D06F 17/08

[52] U.S. Cl. ..... 134/53; 134/133; 134/134

[58] Field of Search ..... 68/4, 53, 134, 68/207, 133, 131

[56] References Cited

U.S. PATENT DOCUMENTS

| | | | |
|---|---|---|---|
| 2,727,379 | 12/1955 | Colston | 68/53 |
| 3,082,616 | 3/1963 | Ohlson | 68/134 |

FOREIGN PATENT DOCUMENTS

| | | | |
|---|---|---|---|
| 62-172991 | 7/1991 | Japan | 68/134 |
| 62-172992 | 7/1991 | Japan | 68/134 |
| 675871 | 7/1952 | United Kingdom | 68/53 |
| 715442 | 9/1952 | United Kingdom | 68/53 |
| 686420 | 1/1953 | United Kingdom | 68/53 |

*Primary Examiner*—Frankie L. Stinson

*Attorney, Agent, or Firm*—Cushman Darby & Cushman Intellectual Property Group of Pillsbury Madison & Sutro, LLP

[57] ABSTRACT

A washing machine with sub-pulsators is disclosed. A pulsator for generating vortical water flow is installed at a bottom of a washing tub, and many sub-pulsators are mounted on an inner side wall of the washing tub. Many ducts for forming passages in a vertical direction are provided in the side wall of the washing tub. When the pulsator is rotated, washing water flows in the ducts by the centrifugal force thereof and moves up along the ducts. The sub-pulsator is rotated by the washing water flowing in the ducts. Thus, a complex water flow is generated by the pulsator and the sub-pulsator, so the washing effect is improved and the twisting and tangling of the laundry is diminished.

8 Claims, 2 Drawing Sheets

WASHING MACHINE WITH SUB-PULSATORS

BACKGROUND OF THE INVENTION

1. Field of the Invention

The present invention relates to a washing machine with sub-pulsators, and more particularly to a washing machine having a plurality of sub-pulsators mounted on an inner side wall of a washing tub in addition to a pulsator mounted on a bottom of the washing tub, whereby a complex water flow is generated in the washing tub.

2. Prior Art

Generally, a washing machine which accommodates laundry and performs washing and dehydrating operations has, as shown in FIG. 1, an outer-tub 1 installed in an out-casing 10, a washing tub 2 installed in the outer-tub 1 for accommodating laundry and water, a pulsator 3 mounted on the bottom of the washing tub 2 for rotating the washing water in the washing tub 2, a driving motor 3 disposed under the outer-tub 1 for driving the pulsator 3, and a gear assembly 5 for transmitting the power of the driving motor 4 selectively to the pulsator 3 and the washing tub 2.

In the washing operation, the power of the driving motor 4 is transmitted to the pulsator 3 through the gear assembly 5 in order to rotate the pulsator 3, by which vortical air flow is generated in the washing tub 2. The pulsator 3 may possibly be rotated in a bilateral direction according to the operation of the driving motor 4. The washing operation of the laundry accommodated in the washing tub 2 is performed by the vortical water flow generated by the pulsator 3.

In the dehydrating operation, the power of the driving motor 4 is transmitted to both the washing tub 2 and the pulsator 3, so the washing tub 2 is rotated together with the pulsator 3 at a high speed. The dehydrating operation is performed by centrifugal force generated in that situation.

In such a conventional washing machine, since the water flow in the washing tub 2 is formed only by the pulsator 3, there is a problem that the water flow in the washing tub 2 is too simple so that the sufficient washing effect cannot be achieved. Furthermore, since the water flow in the washing tub 2 forms merely a vortical water flow by the pulsator 3 during the washing operation, the laundry may be twisted and tangled. Thus, the washing effect may be diminished and more wear and tear upon the laundry may occur.

SUMMARY OF THE INVENTION

The present invention has been proposed to overcome the above described problems in the prior art, and accordingly it is an object of the present invention to provide a washing machine in which a complex water flow in the washing tub can be generated, whereby the washing effect is improved, thus the twisting and tangling of the laundry along with additional wear and tear upon the clothes can be prevented.

To achieve the above object, the present invention provides a washing machine having a washing tub for accommodating laundry and washing water, a pulsator mounted on a bottom of the washing tub for generating vortical water flow in the washing tub, and a motor for driving the pulsator, the washing machine comprising: a plurality of ducts for providing a passage along a vertical direction in an inner side wall of the washing tub, the ducts being formed with an upper port and a lower port for inflow and outflow of the washing water; and a plurality of sub-pulsators mounted on the inner side wall of the washing tub, the sub-pulsators being driven to rotate by a flow of the washing water flowing in the ducts when the pulsator rotates.

Here, it is possible that the sub-pulsator comprises a rotating shaft passing through the inner side wall of the washing tub, one end thereof being protruded inside said washing tub and the other end thereof being placed inside said duct; a rotating wing installed on the rotating shaft, the rotating wing being rotated by the flow of the washing water in the duct; and a water flow generating wing installed on the rotating shaft so as to be rotated together with the rotating wing.

Also, it is preferable that the ducts are symmetrically disposed to a rotational axis of the pulsator and the sub-pulsators are disposed along a longitudinal direction of each duct.

Furthermore, it is more preferable if a filter for filtering dirt in the washing water which has flowed out of the upper port is installed at the upper port of the duct.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
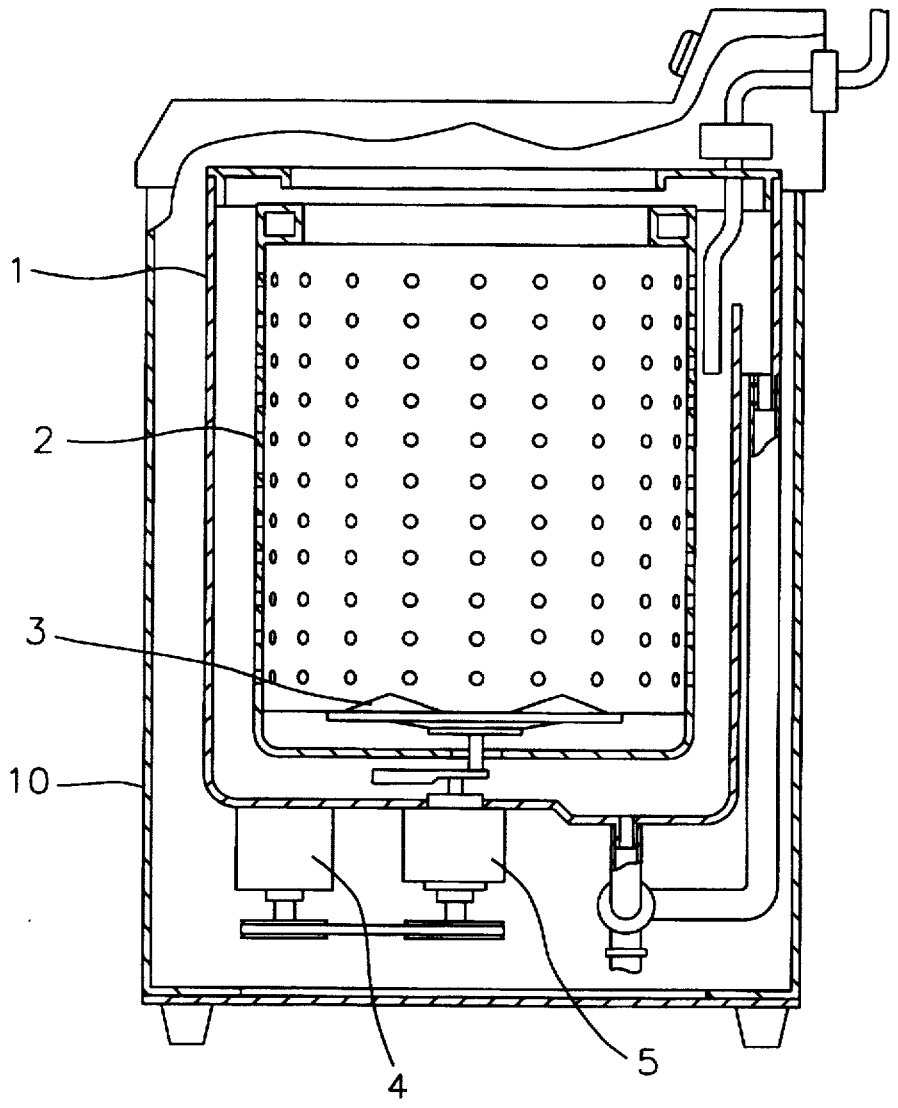
FIG. 1 PRIOR ART
FIG. 1 is a side sectional view of a general washing machine.
Figure 2:
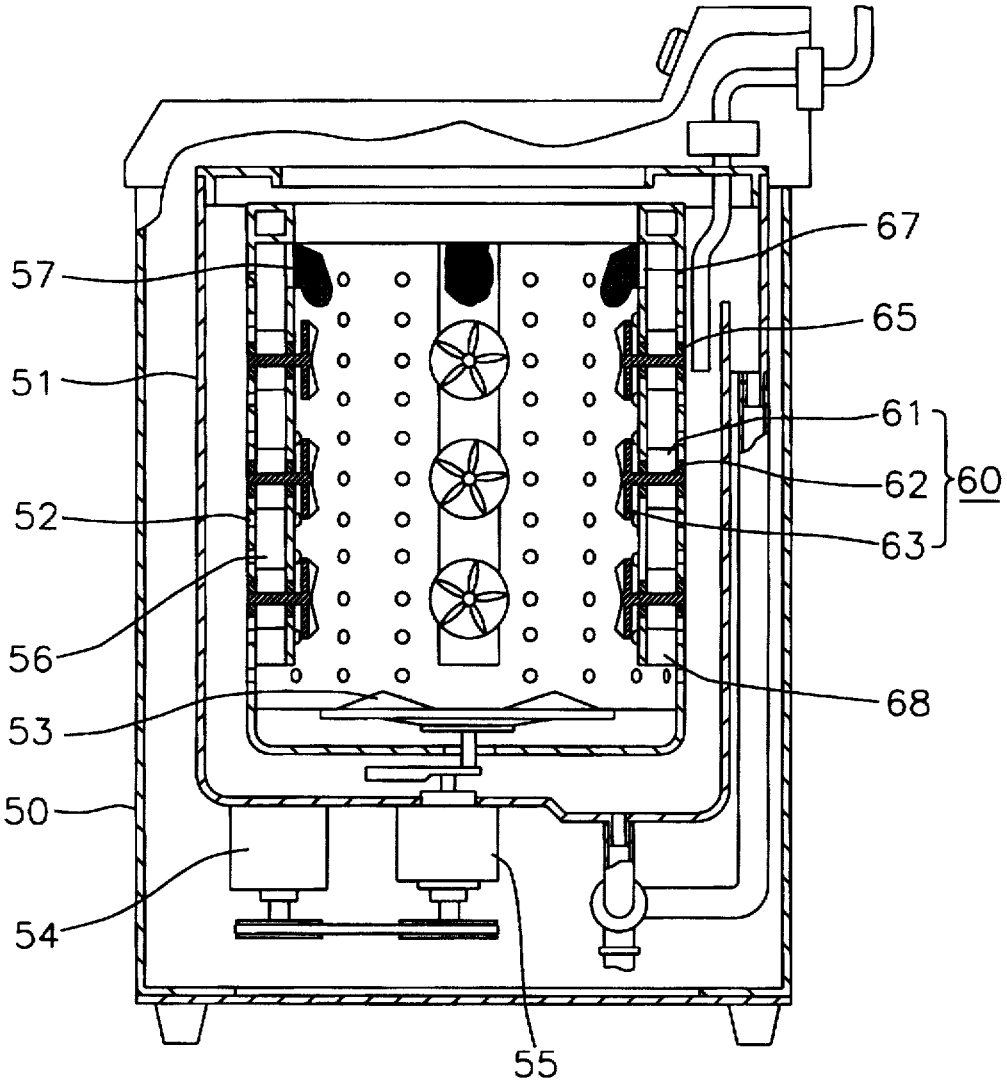
FIG. 2 is a side sectional view of a washing machine according to the present invention.

The washing machine according to the present invention has, as the conventional washing machine shown in FIG. 1, an outer-tub 51 installed in an out-casing 50, a washing tub 52 mounted in the outer-tub 51 for accommodating laundry and water for washing, a pulsator 53 mounted on the bottom of the washing tub 52 for rotating the washing water in the washing tub 52, a driving motor 53 disposed under the outer-tub 1 for driving the pulsator 53, and a gear assembly 55 for transmitting the power of the driving motor 54 selectively to the pulsator 53 and the washing tub 52.

In the side wall of the washing tub 52, a plurality of ducts 56 are disposed. The ducts 56 provide a passage along a vertical direction in the side wall of the washing tub 52. An upper port 67 is formed at the upper end of each duct 56, and a lower port 68 is formed at the lower end of each duct 56. The washing water in the washing tub 52 flows into and flows out from the duct 56 through the upper port 67 and the lower port 68. The ducts 56 are symmetrically disposed to the rotational axis of the pulsator 53.

A plurality of sub-pulsators 60 are mounted on the inner side wall of the washing tub 52. The sub-pulsator 60 consists of a rotating wing 61, a water flow generating wing 63, and a rotating shaft 62. The rotating shaft 62 passes through the inner side wall of the washing tub 52 so that one end thereof protrudes inside the washing tub 52 and the other end thereof lies inside the duct 56. The rotating wing 61 is installed on the rotating shaft 62 in the duct 56, and the water flow generating wing 63 is installed on the rotating shaft 62 in the washing tub 52. The rotating wing 61 is rotated by the flow of the washing water in the duct 56, and during that situation, the water flow generating wing 63 is rotated together with the rotating wing 61. The sub-pulsators 60 are disposed along the longitudinal direction of each duct 56.

The rotating shaft 62 is supported by a plurality of bearings 65 installed in the inner side wall of the duct 56. The rotation of the rotating shaft 62 by the flow of the washing water in the duct 56 becomes smooth by virtue of the bearings 65. The bearings 65 are oilless bearings, which don't require an auxiliary supply of oil. A filter 57 is installed at the upper port 67 of the duct 52. The filter 57 performs filtering operation of the dirt in the washing water that has flowed out of the upper port 67.

Hereinbelow, the operation and the effect of the washing machine according to the present invention will be described.

In the washing operation, the power of the driving motor 54 is transmitted to the pulsator 53 through the gear assembly 55, so the pulsator 53 is rotated, by which vortical air flow is generated in the washing tub 52. The pulsator 53 may possibly be rotated in bilateral rotational direction according to the operation of the driving motor 54.

When the vortical water flow is generated in the washing tub 52 by the pulsator 53, the washing water flows into the ducts 56 through the lower ports 68 by the centrifugal force thereof. The washing water flowing in the ducts 56 moves up along the ducts 56 and then flows into the washing tub 52 through the upper ports 67. During that situation, the washing water flowing in the ducts 56 rotates the rotating wings 61, and accordingly the water flow generating wings 63 are rotated by the rotating wings 61. Thus, the washing water in the washing tub 52 is provided with a rotating force which centers around the rotating shaft 62. The washing water in the washing tub 52 forms a complex water flow with the vortical water flow formed by the pulsator 53 at the bottom of the washing tub 52 along with the rotating water flow in the side thereof formed by each sub-pulsator 60. Accordingly, the washing effect is improved, and the twisting and tangling of the laundry which may occur in the mere vortical water flow is prevented.

The washing water flowing out through the upper port 67 is filtered by the filter 57, and thereafter flowing into the washing tub 52. The filter 57 performs a filtering operation of the dirt which is detached from the laundry during the washing operation, so the dirt in the washing water is diminished, by which the washing operation can be performed more effectively.

The pulsator 53 is rotated in one rotational direction at a predetermined time, and thereafter the rotational direction thereof is converted to the other rotational direction. The rotational direction of the pulsator 53 is, as in the general washing machine, converted at every predetermined time. During the conversion of the rotational direction of the pulsator, the washing water loses the centrifugal force by the rotation thereof, so the washing water in the duct 56 moves down by its own weight. Accordingly, the rotating wings 61 and the water flow generating wings 63 are rotated in a reverse rotational direction to the rotational direction thereof during the upward movement of the washing water. In such a manner, the rotational direction of the sub-pulsator 60 is converted every time the rotational direction of the pulsator 50 is converted, so the washing water in the washing tub 52 forms a more complex water flow.

In the dehydrating operation, the power of the driving motor 54 is transmitted to both the washing tub 52 and the pulsator 53, so the washing tub 52 is rotated together with the pulsator 53 at a high speed. The dehydrating operation is performed by centrifugal force generated in that situation.

As described above, according to the prevent invention, since the complex water flow is generated by the pulsator 53 at the bottom of the washing tub 52 and by the sub-pulsator 60 mounted on the inner surface of the washing tub, the washing effect becomes better, and the twisting and tangling of the laundry does not occur, by which wear and tear of the laundry is prevented.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A washing machine having a washing tub for accommodating laundry and washing water, a pulsator mounted on a bottom of said washing tub for generating vortical water flow in said washing tub, and a motor for driving said pulsator, said washing machine comprising:

a plurality of ducts for providing a passage along a vertical direction in an inner side wall of said washing tub, said ducts being formed with an upper port and a lower port for inflow and outflow of the washing water; and a plurality of sub-pulsators mounted on the inner side wall of said washing tub, said sub-pulsators being driven to rotate by a flow of the washing water flowing into said ducts when said pulsator rotates.

2. The washing machine as claimed in claim 1, wherein said sub-pulsator comprises:

a rotating shaft passing through the inner side wall of said washing tub, one end thereof being protruded inside said washing tub and the other end thereof being placed inside said duct;

a rotating wing installed on said rotating shaft, said rotating wing being rotated by the flow of the washing water in said duct; and a water flow generating wing installed on said rotating shaft to be rotated together with said rotating wing.

3. The washing machine as claimed in claim 2, further comprising a plurality of bearings for rotatably supporting said rotating shaft.

4. The washing machine as claimed in claim 3, wherein said bearings are oilless bearings.

5. The washing machine as claimed in claim 2, wherein said ducts are symmetrically disposed to a rotational axis of said pulsator.

6. The washing machine as claimed in claim 5, wherein said sub-pulsators are disposed along a longitudinal direction of each duct.

7. The washing machine as claimed in claim 1, further comprising a filter installed at the upper port of said duct, said filter for filtering dirt in the washing water flowing out of the upper port.

8. A washing machine having a washing tub for accommodating laundry and washing water, a pulsator mounted on a bottom of said washing tub for generating vortical water flow in said washing tub, and a motor for driving said pulsator, said washing machine comprising:

a plurality of ducts for providing a passage along a vertical direction in an inner side wall of said washing tub, said ducts being symmetrically disposed to a rotational axis of said pulsator and being formed with an upper port and a lower port for inflow and outflow of the washing water;

a plurality of sub-pulsators having a rotating shaft, a rotating wing, and a water flow generating wing, said rotating shaft passing through the side inner wall of said washing tub, one end of said rotating shaft being protruded inside said washing tub and the other end of said rotating shaft being placed inside said duct, said rotating wing being installed on said rotating shaft and being rotated by a flow of the washing water flowing in said ducts when said pulsator rotates, said water flow generating wing being installed on said rotating shaft so as to be rotated together with said rotating wing, said sub-pulsators being disposed along a longitudinal direction of each duct;

a plurality of bearings for supporting said rotating shaft so that said rotating shaft is smoothly rotated; and a filter installed at the upper port of said duct, said filter for filtering dirt in the washing water flowing out of the upper port.

* * * * *